US006294507B1

(12) United States Patent
Dahl

(10) Patent No.: US 6,294,507 B1
(45) Date of Patent: Sep. 25, 2001

(54) OIL ADDITIVE

(75) Inventor: Byron M. Dahl, Watertown, SD (US)

(73) Assignee: New Age Chemical, Inc., Delafield, WI (US)

( * ) Notice: Subject to any disclaimer, the term of this patent is extended or adjusted under 35 U.S.C. 154(b) by 0 days.

(21) Appl. No.: 09/350,550

(22) Filed: Jul. 9, 1999

(51) Int. Cl.[7] ..... C10M 129/26
(52) U.S. Cl. ..... 508/459
(58) Field of Search ..... 508/535, 536, 508/538, 539, 459

(56) References Cited

U.S. PATENT DOCUMENTS 5,385,683 * 1/1995 Ransom ..... 508/535
5,576,273 * 11/1996 Karol ..... 508/364
5,786,307 * 7/1998 Igarashi et al. ..... 508/365

* cited by examiner

*Primary Examiner*—Margaret Medley
*Assistant Examiner*—Cephia D. Toomer
(74) *Attorney, Agent, or Firm*—Andrus, Sceales, Starke & Sawall

(57) ABSTRACT

An additive composition to be incorporate with an oil base such as a petroleum-based lubricating oil. The additive includes the combination of a metal carboxylate, containing a metal such as bismuth, copper, zinc or manganese, and a carboxylic acid in a solvent system. The additive when incorporated with the oil base provides increased corrosion resistance, decreases "washout" capabilities of the oil from the lubricated metal and provides a minimum change of viscosity over a wide range of temperature.

13 Claims, No Drawings

OIL ADDITIVE

BACKGROUND OF THE INVENTION

Lubricating oils, such as motor oil, transmission fluid, gear oil, hydraulic fluid and the like, generally include one or more additives which are designed to enhance certain physical properties of the oil. For example, sulfur and chlorine compounds are frequently added to lubricating oil to increase its film strength. However, water or moisture resulting from condensation can accumulate in the oil and can react with the sulfur or chlorine compounds to produce acidic components which can cause corrosion of the lubricated parts. To counteract the corrosive effect of the acidic components, caustic materials are often added to the oil, but the caustic materials in themselves can produce a corrosive atmosphere.

Lubricating oils are frequently subjected to extreme temperatures in service which can range from about −50° F. to 400° F. In order to provide the oil with a desired viscosity at the normal running temperature, the oil at the start-up of operation may be required to have a high viscosity which tends to produce improper lubrication until the oil temperature is increased as the mechanism is operated. In an attempt to eliminate this problem viscosity stabilizers have been incorporated in lubricating oil.

The typical lubricating oil may also contain additives that impede "wash out"of the oil from the lubricated part, or additives that improve the "drip-down" characteristics of the oil.

SUMMARY OF THE INVENTION

The invention is directed to a composition to be added to oil, particularly lubricating oils, to improve the physical properties of the oil during service.

The additive of the invention is a homogeneous liquid comprising, in general, the combination of a metal carboxylate and a carboxylic acid in a solvent system. In a preferred form of the invention, the metal carboxylate is incorporated in the additive in the form of a premix with a hydrocarbon carrier or solvent. The additive can also contain an oil and small amounts of a conventional defoaming agent and a conventional rust and oxidation inhibitor.

The additive can be incorporated in a wide variety of oils, such as vehicle motor oil, transmission fluid, gear oil, hydraulic fluids, compressor oil, and the like. In practice, the additive is incorporated in the oil in an amount of 0.2 to 5 ounces of the additive per quart of oil.

The oil containing the additive has excellent film strength, a rating of 65 to 80 on the Timken rating scale. This compares with a Timken rating generally in the range of 23 to 45 for a typical lubricating oil. Due to its high Timken rating, which is the pressure required to break the oil film and provide metal-to-metal contact, the use of the oil containing the additive substantially increases the service life of the lubricated equipment.

The additive also provides the oil with excellent "wash-out" capabilities by reducing the surface tension of the oil and enabling the oil to be drawn into the microscopic spaces between the crystalline structures within the matrix of the metal. As the oil is not capable of entraining water, no moisture can contact the metal surfaces, therefore preventing corrosion.

As the oil containing the additive may not contain any sulfur, chlorine or phosphorus components, the corrosion resistance is substantially improved. As the lubricating oil is drawn into the pores of the metal, the drip-down time, which is the time required for the oil to drip from a surface, is substantially improved over conventional lubricating oils. Most oils have a drip-down time of about 4 to 5 hours, while the drip-down time of the oil incorporating the additive of the invention will be several months or more. An important attribute of a long drip down time is that the equipment will not undergo a dry start-up, as moving parts stay lubricated.

The oil containing the additive of the invention will substantially reduce the operating temperature of the oil and cause the oil to be drawn to the area of highest friction, or the "hot spot". This cooling effect results in the viscosity of the oil staying higher than normal, providing increased boundary lubrication. The additive, when used with certain synthetic base stocks, will dramatically increase the viscosity index of the oil to a value of about 242.

Other objects and advantages will appear during the course of the following description.

DESCRIPTION OF THE PREFERRED EMBODIMENT

The invention is directed to a composition or additive to be incorporated in an oil, such as a lubricating oil, and to the oil containing the additive.

In general, the lubricating oil additive is a liquid composition including a metal carboxylate and a carboxylate acid. In a preferred form of the invention, the metal carboxylate is incorporated in the additive in the form of a liquid premix and the additive has the following composition in weight percent:

| | |
|---|---|
| Metal carboxylate premix | 0.5%–99.5% |
| Carboxylic acid | 0.02%–20% |
| Solvent | 0%–98.8% |
| Oil | 0%–95% |
| Defoamer | 0%–1% |
| Rust and oxidation inhibitor | 0%–1.5% |

The metal carboxylate premix is composed of about 18% to 95% by weight of a metal carboxylate with the balance being a liquid hydrocarbon carrier.

Metals such as copper, zinc, bismuth and manganese can be used in preparing the metal carboxylate and the carboxyl radial contains from 6 to 16 carbon atoms. Specific examples of metal carboxylates which can be used in preparing the premix are bismuth neodecanoate, zinc neodecanoate, zinc naphthenate, bismuth 2-ethylhexanoate, copper naphthenate, bismuth naphthenate, and the like.

The carrier in the premix is a liquid hydrocarbon which is miscible with the metal carboxylate and has a flash point in the range of 150° F. to 500° F., and a viscosity of 5 SUS to 2,000 SUS. The carrier acts to thin out the metal carboxylate, which has a relatively high viscosity and provide a pourable liquid. In addition, the carrier stabilizes the color of the premix providing a light brown honey color to the premix. Specific examples of the carrier that can be used in the premix are mineral spirits, mineral oil, neodecanoic acid, octanoic acid, and the like.

The carboxylic acid as used in the additive formulation contains from 6 to 16 carbon atoms and is believed to cooperate with the solvent to fully solubilize the metal carboxylate and also serves to couple all molecules in the formulation together to hold the blend in solution without separation. Specific examples of a carboxylic acid which can be employed in the additive formulation are naphthenic acid, citric acid and the like.

The solvent to be used in the additive composition is any aromatic or aliphatic solvent which is capable of dissolving the components of the composition and has a flash point above 115° F. Specific examples of solvents that can be employed are aliphatic mineral spirits, kerosene, naphthalene depleted aromatic solvents, d-limonene, and the like. When the additive is used in a food oil, the solvent can be a food grade material, such as d-limonene.

The oil to be employed in the additive formulation serves as a diluent and increases the fluidity of the additive. The oil can be a petroleum-based oil, such as a naphthenic or paraffinic oil, a synthetic base stock or silicone oil. When the additive is to be incorporated with an oil to be used in the food industry, the additive formulation can include a vegetable oil, such as soybean oil.

In addition to the above ingredients, a defoaming agent and/or a rust and oxidation inhibitor can also be incorporated in the additive composition. The defoaming agent acts to reduce foaming when the additive is incorporated in a lubricating oil and the oil is used in service. The defoaming agent can be any conventional defoaming material commonly used in lubricating oils and a preferred defoaming agent is a silicone defoamer sold by Ivanhoe Chemical under the trademark Ivanhoe XFO-100, or tributylphosphate sold by Calloway Chemical Company under the trademark Calloway 6814®. A preferred rust and oxidation inhibitor is Elco 148 sold by the Elco Corp.

The additive composition is intended to be incorporated in a wide variety of oils, such as motor oil, transmission fluid, hydraulic fluid, gear oil, penetrating oil, and the like, and is used in varying amounts depending upon the particular oil with which it is incorporated. In general, the additive is used in the amount of 0.2 to 5.0 ounces of additive per quart of oil or fluid. More specifically, with a motor oil, the additive is preferably used in an amount of 0.5 to 2 ounces of additive per quart of motor oil. With transmission fluid, the additive is preferably incorporated in an amount of 0.33 to 1.0 ounces of additive per quart of transmission fluid. When used with gear oil, the additive is preferably used in an amount of 0.5 to 5 ounces per quart of gear oil.

In practice, the additive is prepared by initially mixing the defoamer and rust and oxidation inhibitor with the oil with low speed agitation for about 15 minutes. The solvent, carboxylic premix and carboxylic acid are then added to the mixture and the blend is further agitated for another 15 minute period. The resulting additive composition is generally golden brown in color and is a clear homogenous liquid, being relatively thin, similar to a 20 weight motor oil.

A specific example of an additive to be incorporate with a motor oil is as follows in weight percent:

| | |
|---|---|
| Carboxylic pre-mix (83% bismuth naphthenate and 17% neodecanoic acid) | 38% |
| Naphthenic acid | 2% |
| Mineral oil | 52% |
| Mineral spirits | 7% |
| Calloway 6814 (defoamer) | 0.35% |
| Elco 148 (rust and oxidation inhibitor) | 0.65% |

The above additive can be added to a motor oil in an amount of 0.2 to 2.0 ounces of the additive per quart of motor oil.

The above additive can also be incorporated with a hydraulic fluid in an amount of 0.2 to 3.5 ounces of the additive per quart of the hydraulic fluid.

It is also contemplated that the additive of the invention can be incorporated in a food grade oil product. A specific example of the additive used in this application is as follows in weight percent:

| | |
|---|---|
| Carboxylic premix (83% bismuth naphthenate and 17% neodecanoic acid) | 38% |
| Vegetable oil | 60.5% |
| Calloway 6814 (defoamer) | 0.35% |
| d-Limone (solvent) | 1% |
| Functional Products CL-426 (rust and oxidation inhibitor) | 0.65% |

The above additive can be incorporated with a food grade oil or vegetable oil in the amount of 0.2 to 5 ounces of the additive per quart of the vegetable oil.

The carboxylic acid and solvent, as used in the lubricating oil additive, or the oxidation inhibitor and solvent as used in the food grade additive, provide an important function in maintaining the metal carboxylate in solution and prevent the metal carboxylate from settling out of solution or gelling when the additive is incorporated with an oil product.

The oil with the additive incorporated therein has improved corrosion resistance due to the fact that there are usually no acid producing components, such as sulfur or chlorine compounds, utilized. Water which can accumulate in the oil due to condensation will react with sulfur and chlorine compounds to produce acid components which can be corrosive to the metal parts being lubricated. As the additive of the invention does not incorporate sulfur or chlorine compounds, this cause of corrosion to the metal components is eliminated.

The oil containing the additive of the invention penetrates into the microscopic spaces between the crystalline structures within the matrix of the metal, not allowing moisture to contact the metal surface, preventing corrosion. The oil is also incapable of entraining moisture, becoming water displacing, and because it will not entrain water, the moisture can not come in contact with the metal.

An oil incorporating the additive of the invention in an amount of about 7.5% by weight has a high Timken rating in the range of 65 to 80, which is the pressure required to break the oil film and provide metal-to-metal contact. This Timken rating is substantially greater than conventional lubricating oils which normally have a Timken rating in the range of about 23 to 45.

The additive, when blended as described, has unique heat dispersing characteristics which transfer heat out of the oil and away from "hot spots". This serves to lower the operating temperature of the oil in equipment that is under heavy load by as much as 30%. Because of the effective dispersing capabilities of the oil, particulates that are suspended will not plate out on the sidewalls of the equipment but will stay in suspension and be filtered out. This keeps the oil cleaner and prevents wear within the component.

Oils containing the additive are usable over a wide temperature range of from −50° F. to 600° F. without oxidation of the additive. Other lubricant additives tend to oxidize at around 320° F., breaking down and contaminating the oil.

Due to the combination of ingredients in the additive, the surface tension of the oil is reduced, enabling the oil to be drawn into the pores of the metal, thereby decreasing the "wash-out" of the oil and correspondingly substantially improving the drip-down time of the oil. The additive will cause oil to disperse heat away from a "hot spot" in equipment, but at the same time, it will cause the oil itself to be drawn to, or attracted to the "hot spot". It is believed that, as friction in an area in equipment increases, producing heat, this increased temperature further lowers the surface tension of the oil, which increases its polarity even more. This increased polarity then attracts more oil to this specific area providing better lubrication and reducing friction. Other oils or oil additives do not have this capability to reduce surface tension in this manner, and as heat increases, they tend to thin out and be thrown away from the "hot spot" providing less lubrication.

Various modes of carrying out the invention are contemplated as being within the scope of the following claims particularly pointing out and distinctly claiming the subject matter regarded as the invention.

I claim:

1. An additive to be incorporated with an oil base, consisting essentially of by weight percent 0.2% to 99.5% of a carboxylate premix, 0.02% to 20% of a carboxylic acid, 0% to 95% of an oil, and 0% to 98.8% of a solvent, said carboxylate premix composed of 18% to 95% by weight of a metal carboxylate wherein a metal of the metal carboxylate is bismuth and whereby the carboxyl radical contains from 6 to 16 carbon atoms and 82% to 5% by weight of a liquid organic carrier which is miscible with the carboxylate wherein the carrier is neodecanoic acid.

2. The additive of claim 1, wherein said solvent is selected from the group consisting of an aliphatic solvent and an aromatic solvent, said solvent having a flash point greater than 115° F.

3. The additive of claim 1, and including up to 1.0% defoaming agent.

4. The additive of claim 1, and including up to 1.5% of a rust and oxidation inhibitor.

5. The combination of claim 1, wherein the metal carboxylate is bismuth neodecanoate.

6. The combination of claim 1, wherein the metal carboxylate is bismuth 2-ethylhexanoate.

7. An additive to be incorporated with an oil base, consisting essentially of weight percent 0.2% to 99.5% of a carboxylate premix, 0.02% to 20% of a carboxylic acid, 0% to 95% of an oil, and 0% to 98.8% of a solvent, said carboxylate premix composed of 18% to 95% by weight of a metal carboxylate wherein a metal of said metal carboxylate is zinc and whereby the carboxyl radical contains from 6 to 16 carbon atoms and 82% to 5% by weight of a liquid organic carrier which is miscible with the carboxylate wherein said carrier is mineral oil.

8. A combination of an oil and an effective amount of an additive, the combination comprising:

the oil; and the additive consisting essentially of by weight from 0.5% to 99.5% of a metal carboxylate premix, 0.02% to 20% of a carboxylic acid containing from 6 to 16 carbon atoms, 0% to 95% of oil, 0% to 98.8% of a solvent, 0% to 1.0% of a defoaming agent and 0% to 1.5% of a corrosion inhibitor, said metal carboxylate premix comprising from 5% to 95% by weight of a metal carboxylate containing a metal selected from the group consisting of zinc, bismuth, and manganese, and the balance of the premix being a liquid organic carrier miscible with said metal carboxylate, said metal carboxylate having a carboxyl radical containing from 6 to 16 carbon atoms, said carrier having a flash point above 115° F. and a viscosity of 55 SUS to 2000 SUS.

9. The combination of claim 8, wherein said oil is a petroleum based lubricating oil.

10. The combination of claim 8, wherein the oil is a food grade oil.

11. The combination of claim 8, wherein the carboxylic acid is naphthenic acid.

12. The combination of claim 8, wherein the oil is selected from the group consisting of petroleum oil, synthetic oil, vegetable oil and silicone oil.

13. The combination of claim 8, wherein the carrier is selected from the group consisting of mineral oil, mineral spirits, neodecanoic acid, octanoic acid, d-limonene, and mixtures thereof.

* * * * *